US008421615B2

(12) United States Patent
Ryu et al.

(10) Patent No.: US 8,421,615 B2
(45) Date of Patent: Apr. 16, 2013

(54) METHOD AND SYSTEM FOR LOCATING SENSOR NODE IN SENSOR NETWORK USING TRANSMIT POWER CONTROL

(75) Inventors: Jehyok Ryu, Suwon-si (KR); Sun Gi Kim, Seoul (KR); Hyo Hyun Choi, Seoul (KR); Sun Shin An, Seoul (KR); Sae Young Ahn, Yongin-si (KR); Bum Jin Kim, Seoul (KR)

(73) Assignees: Samsung Electronics Co., Ltd., Samsung-ro, Yeongtong-gu, Suwon-si, Gyeonggi-do (KR); Research and Business Foundation, Korea University, Anam-Dong, Seongbuk-Gu, Seoul (KR)

( * ) Notice: Subject to any disclaimer, the term of this patent is extended or adjusted under 35 U.S.C. 154(b) by 887 days.

(21) Appl. No.: 12/270,898

(22) Filed: Nov. 14, 2008

(65) Prior Publication Data

US 2009/0128298 A1 May 21, 2009

(30) Foreign Application Priority Data

Nov. 15, 2007 (KR) ..... 10-2007-0116815

(51) Int. Cl.
*G08B 1/08* (2006.01)

(52) U.S. Cl.
USPC ..... 340/539.13; 340/568.1; 340/572.1; 340/995.1; 340/995.19; 340/10.1; 455/456.1; 455/456.2; 455/456.3; 455/456.4; 455/456.5

(58) Field of Classification Search ..... None
See application file for complete search history.

(56) References Cited

U.S. PATENT DOCUMENTS

| | | | | |
|---|---|---|---|---|
| 4,209,787 | A * | 6/1980 | Freeny, Jr. | 342/457 |
| 6,894,645 | B1 * | 5/2005 | Akopian et al. | 342/464 |
| 2003/0050077 | A1 * | 3/2003 | Takeuchi et al. | 455/456 |
| 2004/0185873 | A1 * | 9/2004 | Gilkes et al. | 455/456.2 |
| 2008/0042898 | A1 * | 2/2008 | Sharma | 342/450 |
| 2008/0278292 | A1 * | 11/2008 | Nierenberg et al. | 340/10.3 |
| 2009/0102642 | A1 * | 4/2009 | Huseth et al. | 340/539.13 |
| 2009/0286548 | A1 * | 11/2009 | Coronel et al. | 455/456.1 |
| 2010/0164710 | A1 * | 7/2010 | Chung et al. | 340/539.1 |
| 2010/0171657 | A1 * | 7/2010 | Liu | 342/357.09 |

* cited by examiner

*Primary Examiner* — Benjamin C Lee
*Assistant Examiner* — Curtis King
(74) *Attorney, Agent, or Firm* — Cha & Reiter, LLC

(57) ABSTRACT

A method and apparatus for a sensor network having a plurality of reference nodes and a sensor node that enables the sensor node to compute a relative position through transmission range control and position mapping. In transmission range control, each reference node sends location information signals to the sensor node while varying transmission power. In position mapping, the sensor node forms a grid of vertical and horizontal lines corresponding to a square area defined by the neighboring reference nodes, extracts coordinates of intersections in the grid belonging to a shared region between areas covered by location information signals of various transmit power levels from the neighboring reference nodes, and sets the position of the sensor node to the middle points of the extracted coordinates. Each reference node sends a location information signal when a random backoff time expires after reception of a location information request signal.

22 Claims, 11 Drawing Sheets

METHOD AND SYSTEM FOR LOCATING SENSOR NODE IN SENSOR NETWORK USING TRANSMIT POWER CONTROL

CLAIM OF PRIORITY

This application claims priority to an application entitled "METHOD AND SYSTEM FOR LOCATING SENSOR NODE IN SENSOR NETWORK USING TRANSMIT POWER CONTROL" filed in the Korean Intellectual Property Office on Nov. 15, 2007 and assigned Serial No. 2007-0116815, the contents of which are incorporated herein by reference in its entirety.

BACKGROUND OF THE INVENTION

1. Field of the Invention

The present invention relates generally to a sensor network including reference nodes and sensor nodes. More particularly, the present invention relates to a sensor node locating method and system that enable a sensor node to receive location information signals with successively varying signal strength from plural reference nodes and to compute the coordinates of the location of the sensor node and an associated error.

2. Description of the Related Art

It is expected that various new services will be created in the near future through ubiquitous computing or ubiquitous networks. In particular, location-based services, based on identification of locations of objects, such as persons and things anytime anywhere, are on the rise as important services. Location-based services using location and geographical information have demonstrated their usefulness in various fields, and are advancing beyond a particular business area to technologies heightening the value of an entire country. Most location-based services have been developed using the Global Positioning System (GPS), and ignored shadow areas. Currently, research is underway to provide location-based services in shadow areas, with the help of existing massive network infrastructure and digital equipment. In particular, active research is in progress by many in the field, particularly with regard to position locating techniques based on sensor networks because of their wide application areas.

Sensor network-based locating techniques are used in diverse application areas including logistics, security, home automation, factory automation, and building automation, and are particularly effective for services utilizing locations of individual persons and things such as protection of elderly and disabled persons or children, identification of positions of soldiers in battle, rescue of firefighters isolated or lost in the scene of a fire, and medical treatment. The content of information to be collected from sensor networks tends to be growing, and, in particular, identification of the location of a person wearing a sensor or a thing with an attached sensor has become important.

Infrared rays, ultrasonic waves and radio frequency (RF) waves are used for locating positions of objects such as persons. RF-based position location may result in a large error in the determined position and the actual position, because RF signals are very sensitive to external environmental conditions. RF-based locating services require accuracy in obtained location data. Hence, there is a need to provide a technique that increases accuracy in position locating so that an RF-based locating system can extend the service area to cover shadow areas.

SUMMARY OF THE INVENTION

The present invention has been made in part in view of at least some of the above problems, and the present invention provides a method and system for locating a sensor node in a sensor network. The sensor network includes reference nodes and sensor nodes. In response to a signal requesting location information from a sensor node, a reference node sends its location information to the sensor node while varying transmission power (transmission range control). After reception of location information signals from plural reference nodes, the sensor node forms a grid corresponding to a typically square area defined by absolute coordinates of the reference nodes, and calculates its own location (position mapping) and an associated error.

In accordance with an exemplary embodiment of the present invention, there is provided a position locating system for a sensor network, which may include:

a plurality of reference nodes, each having location information; and a sensor node computing a location thereof on the basis of location information of the reference nodes. One or more of the reference nodes may include a control section generating, upon reception of a location information request signal, a location information signal including a transmit power level and location information of the reference node; and a radio frequency (RF) section forwarding the received location information request signal to the control section, controlling transmission power according to the transmit power level of the control section to send the generated location information signal.

In addition, one or more of the sensor nodes may include a control unit computing a location of the sensor node and associated error on the basis of location information signals received from multiple neighbor reference nodes;

an RF unit sending a location information request signal, and receiving location information signals and forwarding the same to the control unit; and a storage unit storing the location information signals received from multiple neighbor reference nodes.

In accordance with another exemplary embodiment of the present invention, there is provided a method for a sensor network having a plurality of reference nodes and a sensor node, which may include transmitting, by the sensor node, a location information request signal; and transmitting, by neighbor reference nodes in response to reception of the location information request signal, location information signals to the sensor node while varying transmission power; and computing, by the sensor node, a location of the sensor node and associated error after reception and analysis of the location information signals.

In another exemplary aspect of the present invention, the location of a sensor node may be identified using transmission range control and position mapping. Reference nodes send location information upon request from sensor nodes, thereby reducing the amount of traffic generated in the network. Compared with triangulation, an exemplary aspect of the method of the present invention may perform more operations, but result in a smaller error range by using location information collected from, for example, four reference nodes forming a square to calculate its own location. In addition, the RF module of the present invention is advantageously more cost-effective than a module using a different wireless medium, and can be widely utilized.

BRIEF DESCRIPTION OF THE DRAWINGS

The above features and advantages of the present invention will be more apparent from the following detailed description in conjunction with the accompanying drawings, in which.

DETAILED DESCRIPTION

Hereinafter, exemplary embodiments of the present invention are described in detail with reference to the accompanying drawings. The examples shown and described herein are provided for illustrative purposes only, and the claimed invention is not limited to the examples shown and described. The same reference symbols are used throughout the drawings to refer to the same or similar parts. For the purposes of clarity and simplicity, detailed descriptions of well-known functions and structures incorporated herein may be omitted to avoid obscuring appreciation of the subject matter of the present invention by a person of ordinary skill in the art.

In the description hereinbelow, a reference node is typically a node that is aware of its own absolute position. Upon reception of a signal requesting location information from a sensor node, the reference node sends location information to the sensor node while varying transmission power. The position of a reference node may be changed or fixed at a particular point according to its characteristics.

A sensor node is typically a node that sends a signal requesting location information to a reference node to identify its relative position.

Figure 1:
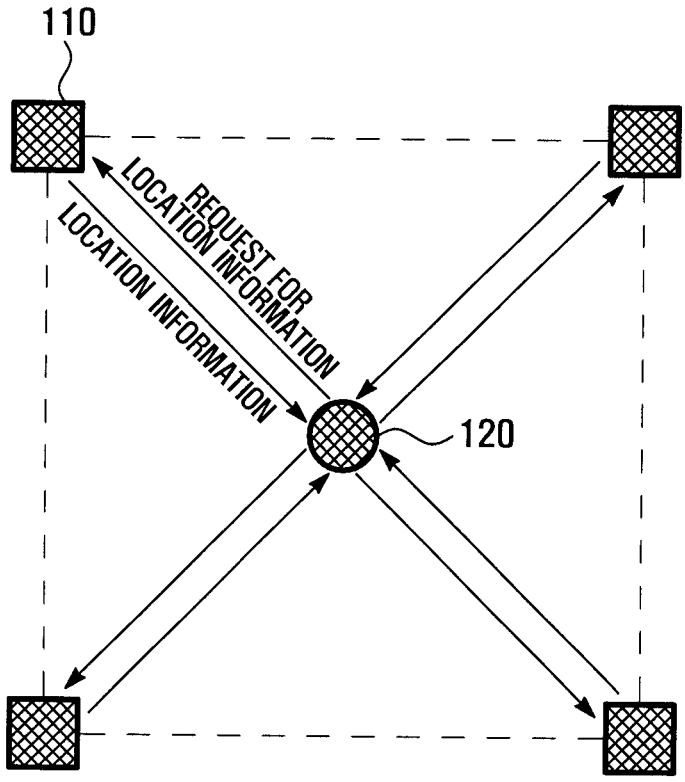
FIG. 1 is a diagram illustrating interactions between a sensor node requesting location information and reference nodes providing location information.

Now referring to FIG. 1, which illustrates a sensor network including reference nodes 110 and sensor node 120, a sensor node 120 sends a location information request signal to reference nodes 110 and then receives signals carrying location information from the reference node 120.

The reference nodes 110 are aware of their own absolute positions. Typically upon reception of a location information request signal from the sensor node 120, the reference nodes 110 send their location information to the sensor node 120 while varying their transmission power. Absolute positions are given by a geographic code system including latitude and longitude. The reference nodes 110 may obtain their own location information using various techniques including the GPS. The positions of the reference nodes 110 may be changeable or fixed at particular points according to their characteristics. For position locating, the reference nodes 110 may be arranged to form a square, regular triangle, or regular hexagon. In the following description, the reference nodes 110 are assumed to be arranged at corners of a square.

In order to identify its relative position, the sensor node 120 sends a location information request signal to the reference nodes 110. The sensor node 120 calculates its position and associated error range using received location information signals. The range of the sensor node 120 may be designed to be confined to an indoor environment such as a room or building.

The sensor node 120 connects to the network, and sends a location information request signal to the reference nodes 110 in the vicinity if necessary. Upon reception of the request signal, the reference nodes 110 send their location information to the sensor node 120 while varying their transmission power. Location information from a reference node 110 includes message type, identifier of the reference node, absolute coordinates, transmit power level, maximum distance and minimum distance. The sensor node 120 receives location information signals, and calculates its position and an error comprising a difference between the calculated position and true position.

Figure 2:
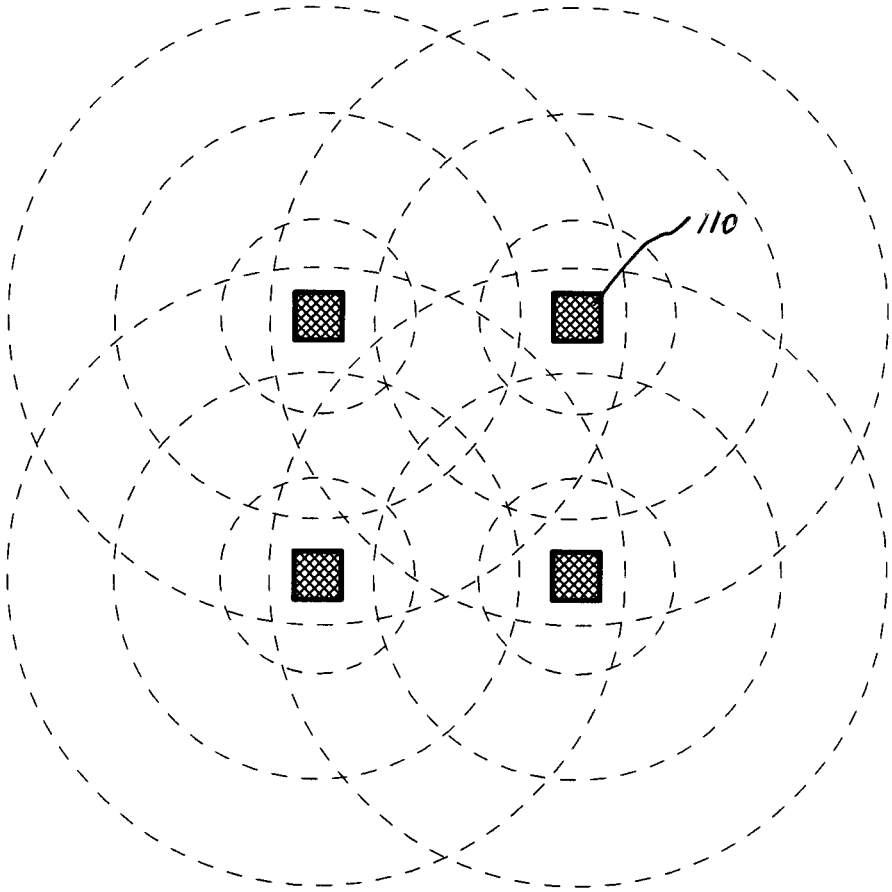
FIG. 2 illustrates regions formed through transmission range control performed by reference nodes sending location information signals while varying transmission power.

FIG. 2 illustrates regions formed through transmission range control performed by reference nodes 110 that send location information signals while varying their transmission power in response to a location information request signal from a sensor node 120 (not shown in FIG. 2).

Upon reception of a location information request signal from a sensor node 120, reference nodes 110 send location information signals to the sensor node 120 while varying transmission power according to their location information (transmission range control). Transmission ranges of location information signals emitted by a reference node 110 with varying transmit power levels can be represented by donut-shapes as shown in FIG. 2. The sensor node 120 can be located at a region shared between donut-shapes formed by location information signals from the reference nodes 110. Table 1 illustrates maximum transmission distances and minimum transmission distances of location information signals according to transmit power levels, and realistic values can be obtained from RF manufacturers or measured through experiments.

TABLE 1

| Transmit power level | Maximum distance (radius) | Minimum distance (radius) |
|---|---|---|
| level 1 | $D_1$ | $D_0$ |
| level 2 | $D_2$ | $D_1 + 1$ |
| level 3 | $D_3$ | $D_2 + 1$ |
| level 4 | $D_4$ | $D_3 + 1$ |
| — | — | — |
| — | — | — |
| — | — | — |
| level N | $D_N$ | $D_{N-1} + 1$ |

In Table 1 above, the minimum distance associated with a particular transmit power level is greater than the maximum distance associated with the previous transmit power level, and this is represented by '+1'. '$D_0$' means 0 (cm). Signals travel farther with increasing transmit power level. At a given transmit power level, the signal power at a receiver decreases with increasing distance.

Several commercially available products employ transmission range control, and the CC2420 RF transceiver (Texas Instruments®) used in the present invention has eight transmit power levels. Table 2 illustrates maximum and minimum transmission distances of the CC2420 RF transceiver according to transmit power levels (obtained through experiments).

TABLE 2

| Transmit power level | Maximum distance (cm) | Minimum distance (cm) |
|---|---|---|
| level 1 | 18 | 0 |
| level 2 | 80 | 19 |
| level 3 | 135 | 81 |
| level 4 | 220 | 136 |
| level 5 | 290 | 221 |
| level 6 | 400 | 291 |
| level 7 | 600 | 401 |
| level 8 | 750 | 601 |

Referring to Table 2 above, at power level 1, a transmission signal can travel from a minimum distance of 0 cm to a maximum distance of 18 cm. At power level 2, a transmission signal can travel from a minimum distance of 0 cm to a maximum distance of about 80 cm. However, because the range between 0 cm and 10 cm can be covered by a transmission signal of power level 1, the range associated with a transmission signal of power level 2 is given by a range of about 19 to 80 cm. Accordingly, a sensor node requesting location information receives location information signals of various transmit power levels from the same reference node, and extracts location information from one of the received location information signals having the lowest transmit power level. For example, a sensor node at a range covered by power level 1 receives signals of 1 to 8 power levels, but uses only the signal of power level 1, sent at the lowest power level, for position locating.

Figure 3:
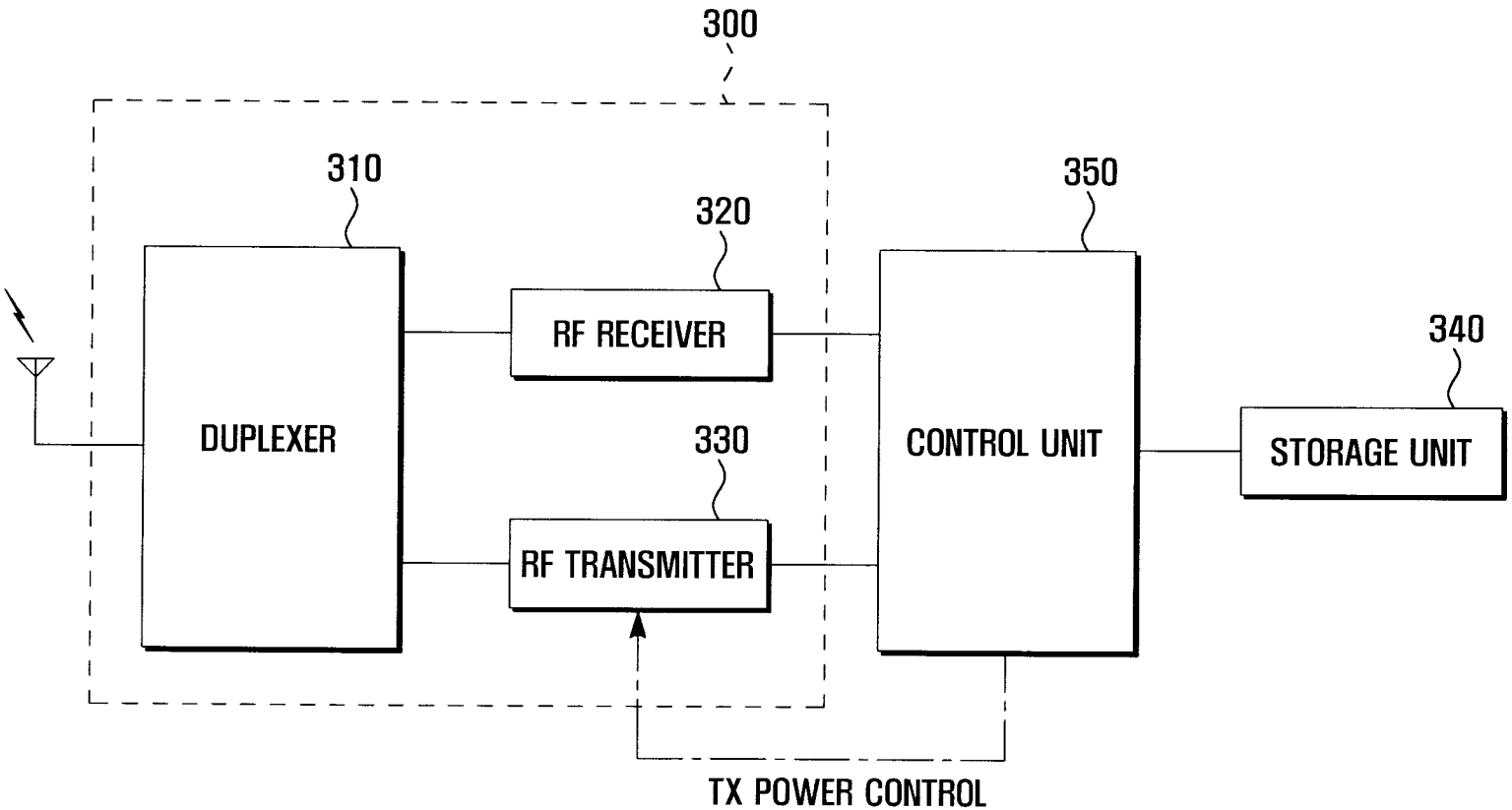
FIG. 3 is a block diagram illustrating a reference node in accordance with the present invention.

FIG. 3 is a block diagram illustrating an example of the structure of a reference node 110 in accordance with the principles of the present invention. The reference node 110 may include an RF communication unit 300 including a duplexer 310, RF receiver 320 and RF transmitter 330, storage unit 340, and control unit 350. These functions may be incorporated by fewer components than shown in FIG. 3.

The duplexer 310 is connected to an antenna, and separates transmit and receive frequencies from each other to prevent interference. The RF receiver 320 low-noise amplifies a received signal and downconverts the frequency of the received signal, and the RF transmitter 330 upconverts the frequency of a signal to be transmitted and amplifies the signal.

The storage unit 340 typically stores programs and data necessary for operating the reference node 110. In particular, the storage unit 340 can store a program necessary for providing transmission range control.

The control unit 350 controls the overall operation of the reference node 110. In particular, the control unit 350 controls the RF transmitter 330 to send location information signals to the sensor node 120 while varying transmission power according to the transmit power level related to location information of the reference node 110 (transmission range control). When in transmission range control, upon reception of a location information request signal from a sensor node 120, the reference node 110 successively sends location information signals to the sensor node 120 while varying transmission power according to transmit power levels. Transmission ranges of location information signals transmitted by a reference node 110 with varying transmit power levels can be represented by donut-shapes as shown, for example in FIG. 2. The sensor node 120 can be located at a region shared between donut-shapes formed by location information signals emitted from the reference nodes 110. Other shapes may also be used.

Figure 4:
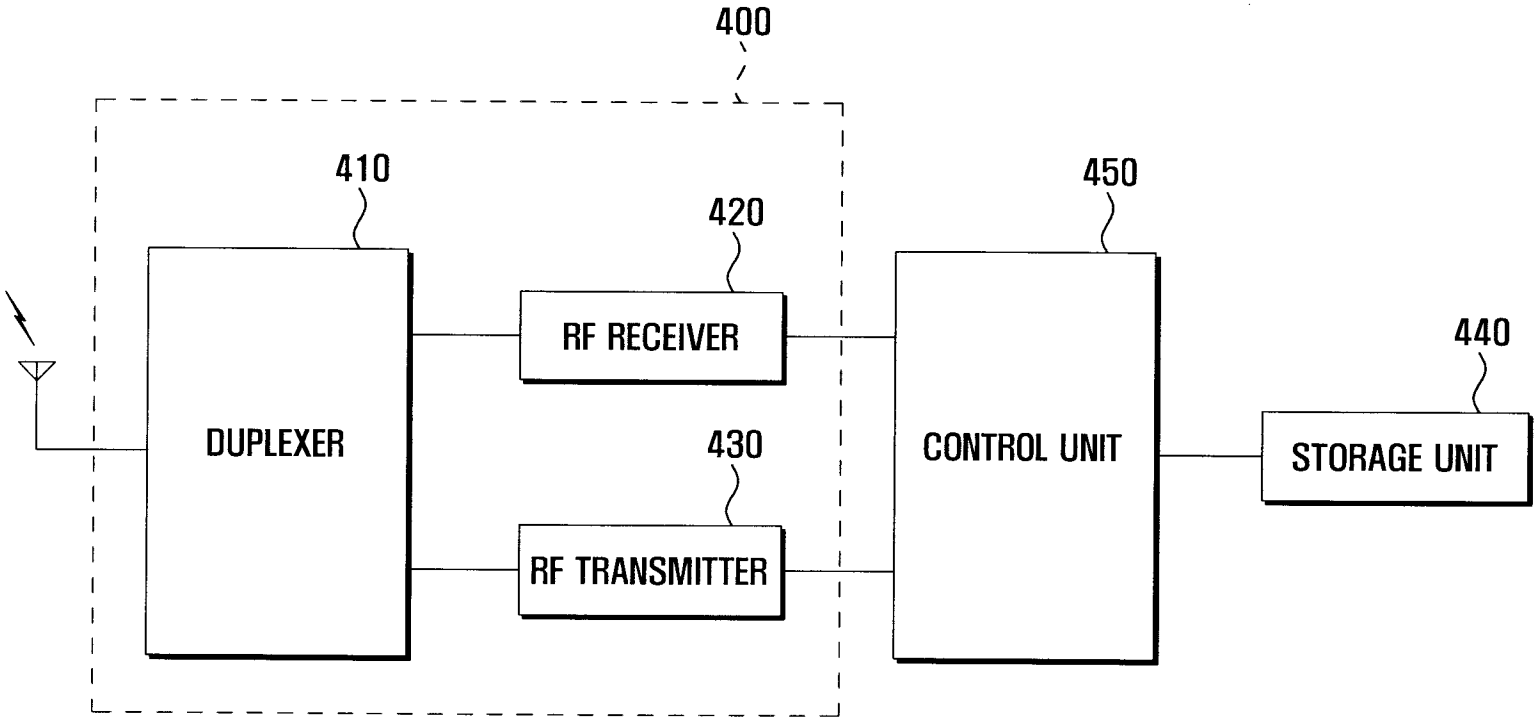
FIG. 4 is a block diagram illustrating a sensor node in accordance with the present invention.

FIG. 4 is a block diagram illustrating an example of the structure of a sensor node 120 in accordance with the principles of the present invention. The sensor node 120 typically includes an RF communication unit 400 including a duplexer 410, RF receiver 420 and RF transmitter 430, storage unit 440, and control unit 450.

The duplexer 410 is connected to an antenna, and separates transmit and receive frequencies from each other to prevent interference. The RF receiver 420 low-noise amplifies a received signal and downconverts the frequency of the received signal, and the RF transmitter 430 upconverts the frequency of a signal to be transmitted and amplifies the signal.

The storage unit 440 stores programs and data necessary for operating the sensor node 120. In particular, when transmit power levels of reference nodes are the same in pattern, the storage unit 440 can pre-store the information in Table 1 related to maximum and minimum transmission distances of location information signals according to transmit power levels, in which case location information from reference nodes 110 may not include data on maximum and minimum transmission distances. The storage unit 440 can temporarily store location information from reference nodes 110.

The control unit 450 controls the overall operation of the sensor node 120. In particular, the control unit 450 controls the RF receiver 420 to receive location information signals having various transmit power levels from the reference nodes 110. After reception of the location information signals having various transmit power levels, the control unit 450 can compute the relative position and associated error of the sensor node 120 through position mapping.

Position mapping is a technique that is employed by the present invention to determine the location of the sensor node 120. In other words, in position mapping, the control unit 450 of the sensor node 120 controls the RF receiver 420 to receive location information signals successively emitted from multiple reference nodes 110, and stores the received location information signals in the storage unit 440. The control unit 450 obtains maximum and minimum x-coordinates and maximum and minimum y-coordinates from stored absolute coordinates of the reference nodes 110. The control unit 450 forms a grid of m vertical lines and n horizontal lines on the basis of the obtained maximum and minimum x-coordinates and maximum and minimum y-coordinates of the neighbor reference nodes 110. The control unit 450 checks if each of m×n intersections of the grid belongs to the region shared between areas covered by location information signals of various transmit power levels from the reference nodes 110. The control unit 450 extracts coordinates of those intersections belonging to the shared region, and sets the position of the sensor node 120 to the middle points of the extracted coordinates.

Figure 5:
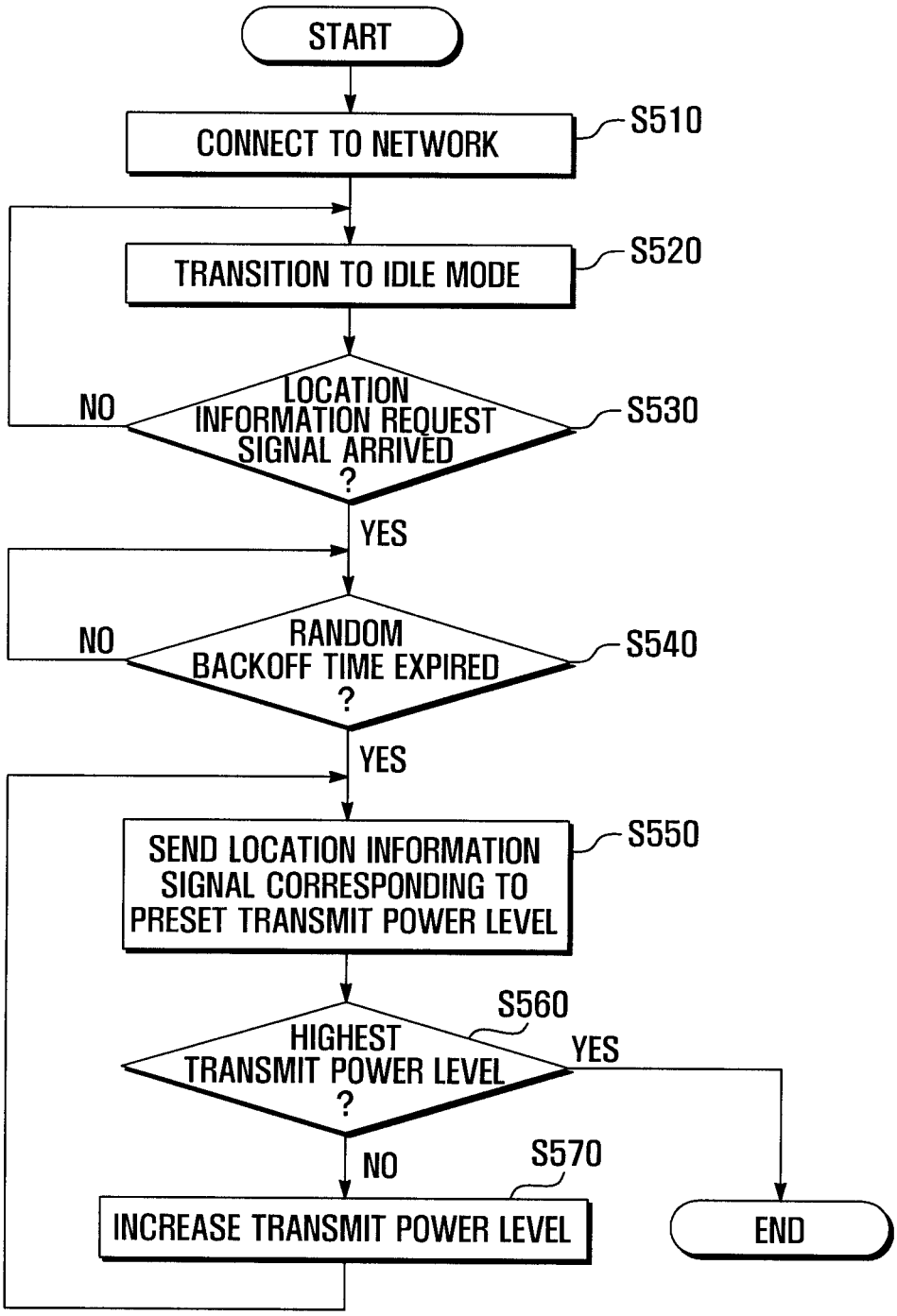
FIG. 5 is a flow chart illustrating an example of a procedure performed by a reference node to send location information using transmission range control to a sensor node in a position locating method according to another exemplary embodiment of the present invention.

FIG. 5 is a flow chart illustrating an example of a procedure performed by a reference node 110 to send location information using transmission range control to a sensor node 120.

Referring to FIG. 5, the control unit 350 of the reference node 110 connects to the network (S510), and transitions to an idle mode (S520). In the idle mode, the control unit 350 checks whether or not a location information request signal from a sensor node 120 is received through the RF receiver 320 (S530). If a location information request signal is received, the control unit 350 waits for a random backoff time (S540). After the random backoff time expires, the control unit 350 controls the RF transmitter 330 to successively send location information signals to the sensor node 120 while varying transmission power according to the transmit power level related to location information (transmission range control). In other words, the control unit 350 controls the RF transmitter 330 to send a location information signal corresponding to a preset transmit power level to the sensor node 120 (S550). The control unit 350 checks whether the current transmit power level is equal to the highest transmit power level (S560). If the current transmit power level is not equal to the highest transmit power level, the control unit 350 increases the current transmit power level (S570). The control unit 350 repeats steps S550 and S560 until the current transmit power level is equal to the highest transmit power level. The duration to send a location information signal can be adjusted using a timer.

Still referring to FIG. 5, location information from the reference node 110 includes message type, reference node identifier, absolute coordinates, transmit power level, maximum distance and minimum distance. The message type indicates that the message is for position locating. The reference node identifier identifies a particular reference node. The absolute coordinates are given by a geographic code system including latitude and longitude. The reference node 110 may obtain its own absolute location using various techniques including the GPS as a representative one. The transmit power level is related to the transmission power of a location information signal emitted by the reference node 110. Signals travel farther with an increasing transmit power level. At a given transmit power level, the signal power at a receiver decreases with increasing distance. The transmit power level is not measured at a sensor node but contained in a location information signal emitted by the reference node 110.

Figure 6:
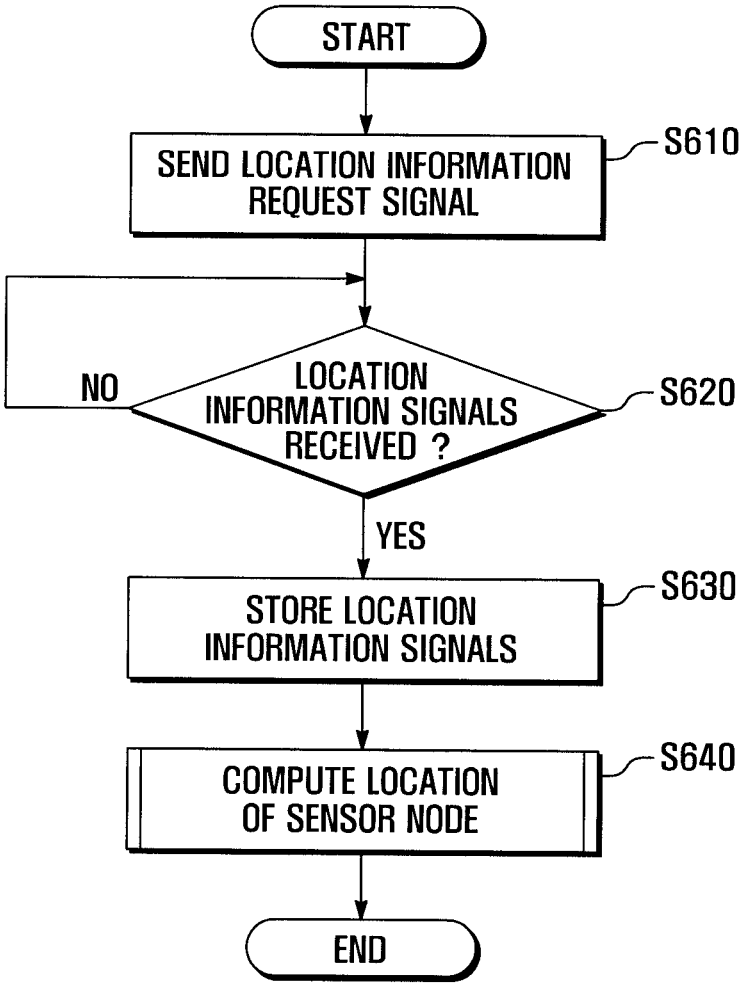
FIG. 6 is a flow chart illustrating an example of a procedure performed by a sensor node to send a signal requesting location information to a reference node and to receive corresponding location information in the position locating method of FIG. 5.

FIG. 6 is a flow chart illustrating an example of a procedure performed by a sensor node 120 to send a signal requesting location information to a reference node 110 and to receive corresponding location information from the reference node 110 according to an exemplary embodiment of the present invention.

Referring to FIG. 6, the control unit 450 of the sensor node 120 controls the RF transmitter 430 to send a location information request signal to multiple reference nodes 110 if necessary (S610). Thereafter, the control unit 450 controls the RF receiver 420 to receive location information signals from the multiple reference nodes 110 (S620), and temporarily stores the receive location information signals in the storage unit 440 (S630). After a preset time duration, the control unit 450 computes the relative position of the sensor node 120 and associated error using the location information of the reference nodes 110 stored in the storage unit 440 and position mapping (S640).

Figure 7:
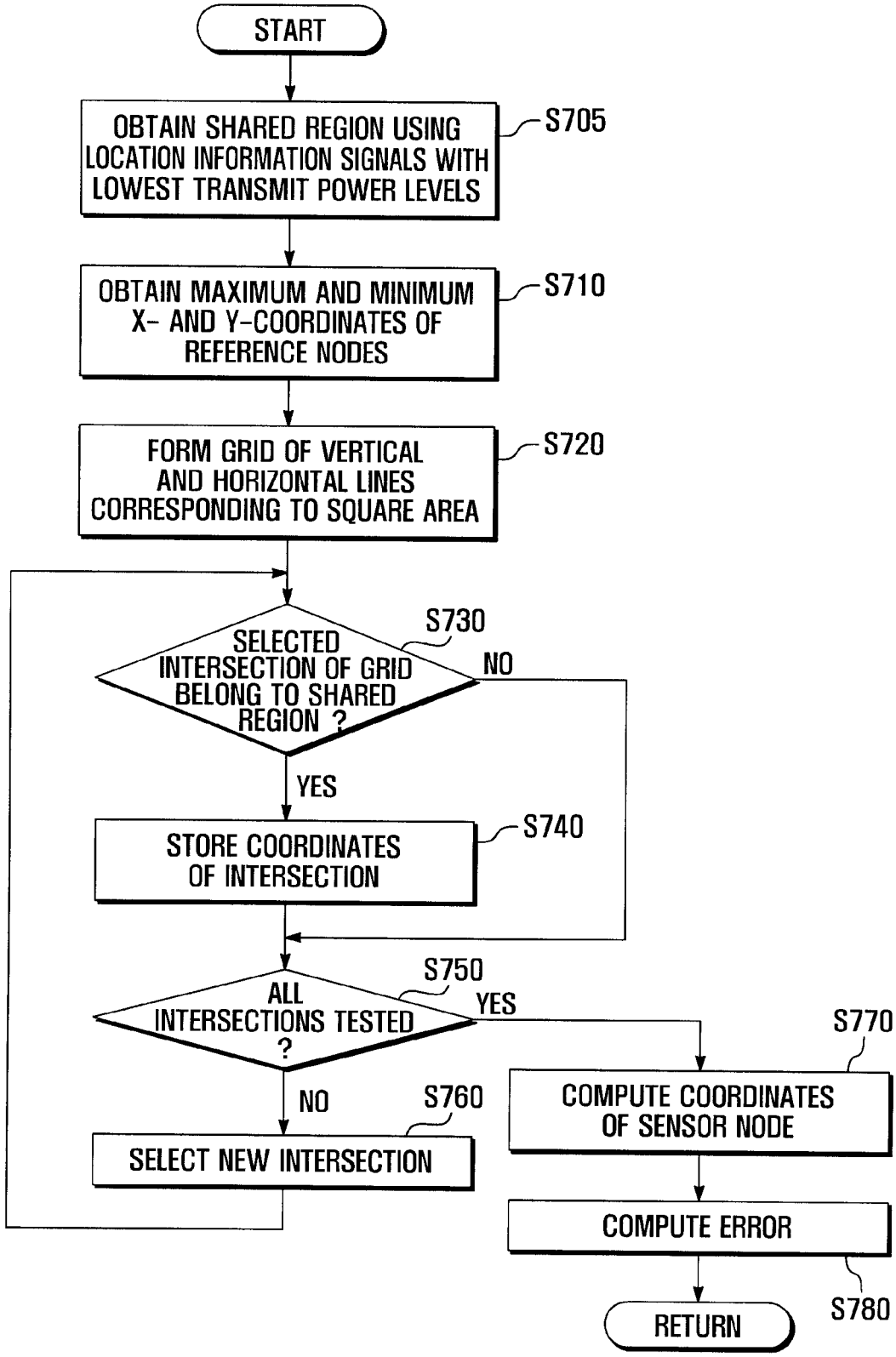
FIG. 7 is a flow chart illustrating an example of a procedure performed by a sensor node to calculate the relative position and associated error using signals carrying location information from reference nodes in the position locating method of FIG. 5.

FIG. 7 is a flow chart illustrating a procedure performed by a sensor node 120 to calculate the relative position and associated error using signals carrying location information from reference nodes 110.

Referring to FIG. 7, the control unit 450 of the sensor node 120 temporarily stores location information received from the reference nodes 110 in the storage unit 440, and, after a preset time duration, obtains the region shared between areas covered by location information signals of various transmit power levels from the reference nodes 110 on the basis of the stored location information (S705). At step S705, a sensor node receives location information signals of various transmit power levels from a single reference node, and extracts location information from one of the received location information signals having the lowest transmit power level. For example, a sensor node at a range covered by power level 1 receives signals of 1 to 8 power levels, but uses only the signal of power level 1, sent at the lowest power level, for position locating.

Figure 8:
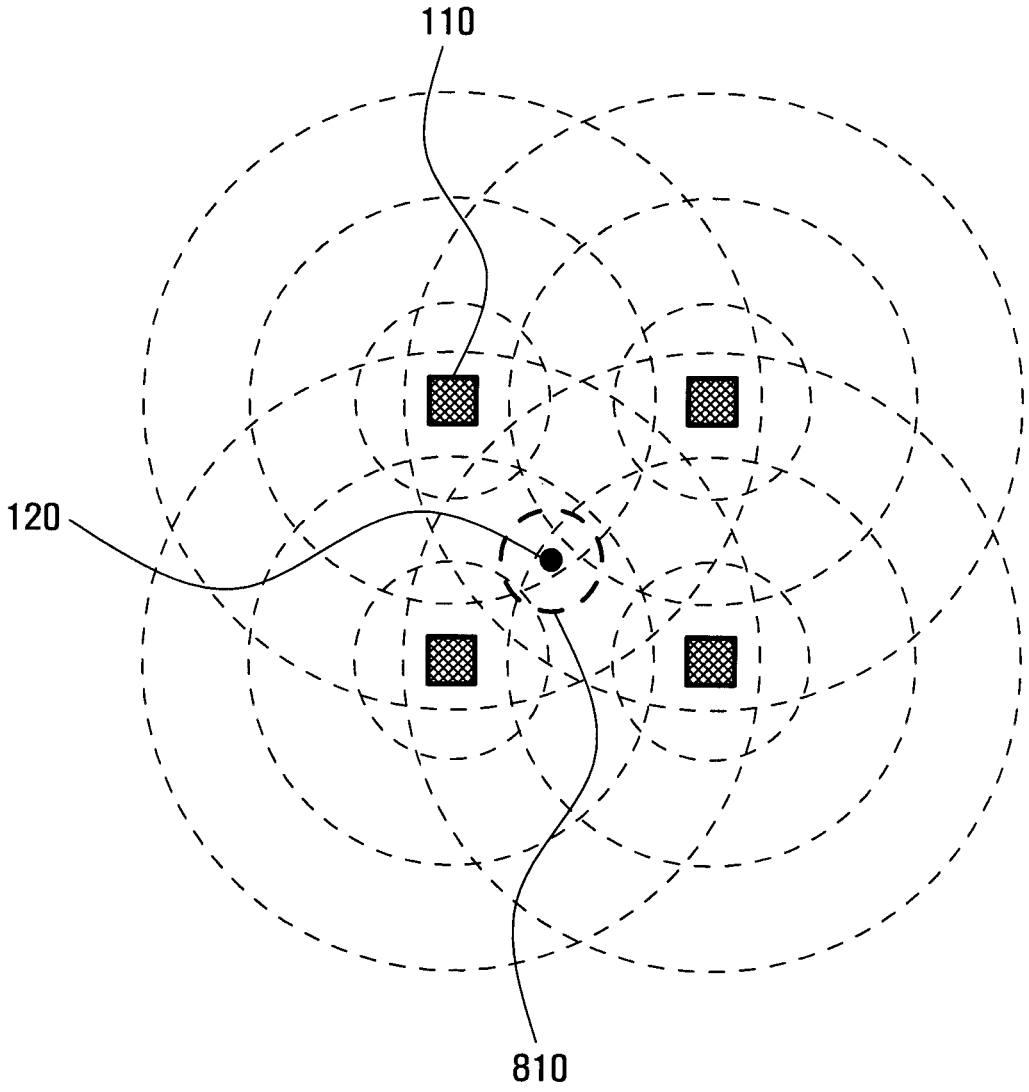
FIG. 8 illustrates a sensor node arranged within a shared region formed by maximum and minimum distances associated with transmit power levels.

FIG. 8 illustrates a sensor node 120 arranged within a shared region 810 between areas covered by location information signals of various transmit power levels from the reference nodes 110. If a location information request signal from a sensor node 120 is received, the reference nodes 110 send location information signals to the sensor node 120 while varying their transmission power according to transmit power levels related to location information. The reference nodes 110 can be arranged to form a square. Transmission ranges of location information signals emitted by a reference node 110 with varying transmit power levels can be represented by donut-shapes as shown in FIG. 8, and a shared region 810 can be formed using maximum and minimum distances related to transmit power levels of the four reference nodes 110 forming a square.

Referring now back to FIG. 7, the control unit 450 obtains maximum and minimum x-coordinates and maximum and minimum y-coordinates of the reference nodes 110 using absolute coordinates in stored location information (S710).

Figure 9:
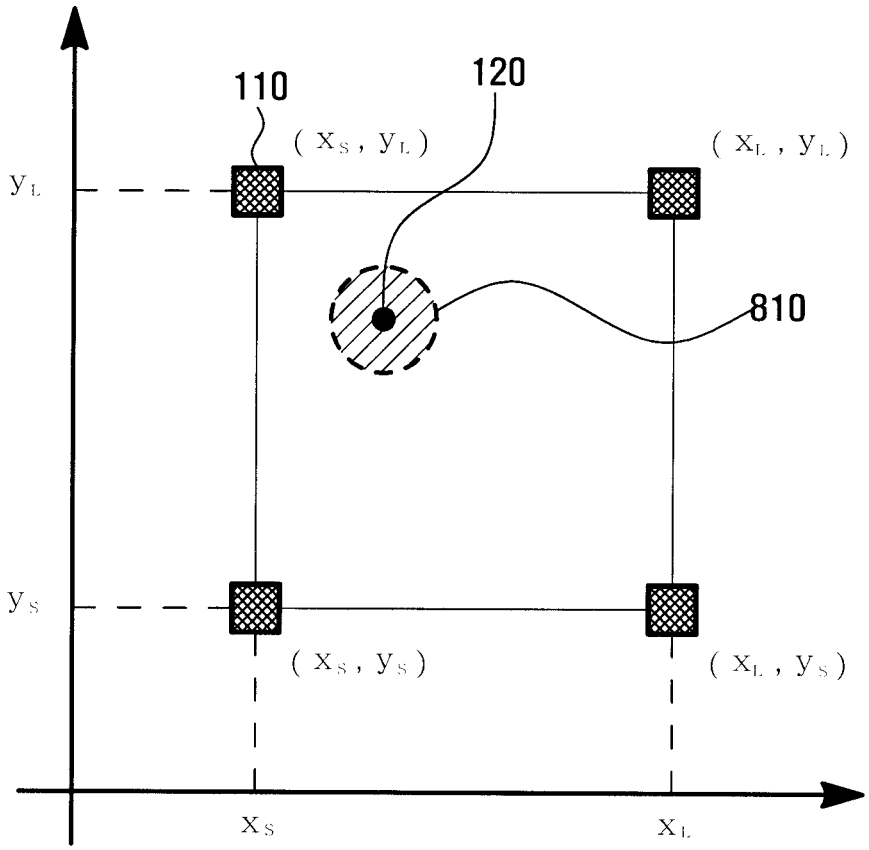
FIG. 9 illustrates extraction of maximum and minimum x and y coordinates of reference nodes.

FIG. 9 illustrates an example of the extraction of maximum and minimum x- and y-coordinates of the reference nodes. Each reference node 110 sends a location information signal including absolute coordinates thereof, and hence the control unit 450 of a sensor node 120 can be aware of the absolute coordinates of the reference node 110. In FIG. 9, among the absolute coordinates of the reference nodes 110 assumed to form a square, the minimum x-coordinate is denoted by $x_S$, the maximum x-coordinate is denoted by $x_L$, the minimum y-coordinate is denoted by $y_S$, and the maximum y-coordinate is denoted by $y_L$.

Referring now back to FIG. 7, the control unit 450 forms a grid of vertical and horizontal lines corresponding to the square area defined by the maximum and minimum x- and y-coordinates (S720). Thereafter, the control unit 450 checks whether a selected intersection of the grid belongs to the shared region 810 (S730). If the selected intersection belongs to the shared region 810, the control unit 450 controls the storage unit 440 to store the coordinates of the selected intersection (S740). If the selected intersection does not belong to the shared region 810, the control unit 450 then skips step S740. The control unit 450 checks whether all intersections of the grid are processed (S750). If not all intersections are processed, the control unit 450 selects an unprocessed intersection of the grid (S760), and returns to step S730. The control unit 450 repeats steps S730 to S760 until all intersections of the grid are tested for inclusion.

Figure 10:
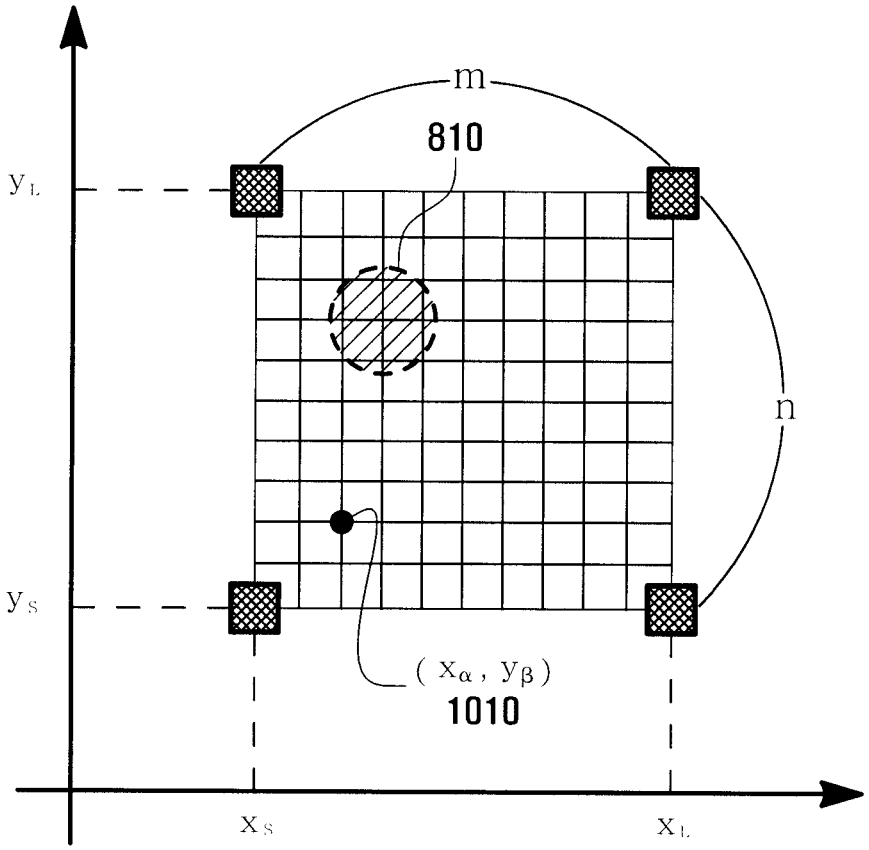
FIG. 10 illustrates determination of whether an intersection point, in a grid of vertical and horizontal lines corresponding to a square area defined by maximum and minimum x- and y-coordinates of reference nodes, belongs to the shared region.

FIG. 10 illustrates a determination of whether an intersection point, in a grid corresponding to a square area defined by maximum and minimum x- and y-coordinates of reference nodes, belongs to the shared region 810. There are m×n intersections in the square area, and each intersection 1010 has its absolute coordinate ($x_\alpha$, $y_\beta$). The control unit 450 selects one of the intersections, tests whether the selected intersection belongs to the shared region 810, and stores, if the selected intersection belongs to the shared region 810, the coordinates of the selected intersection in the storage unit 440. This process is continued until all intersections are tested.

After testing all intersections, the control unit 450 computes the coordinates corresponding to the location of the sensor node 120 (S770). At step S770, the control unit 450 finds the maximum and minimum x and y values from the stored coordinates of those intersections belonging to the shared region 810. For those intersections belonging to the shared region 810, the minimum x-coordinate is denoted by $x_{SS}$, the maximum x-coordinate is denoted by $x_{SL}$, the minimum y-coordinate is denoted by $y_{SS}$, and the maximum y-coordinate is denoted by $y_{SL}$. Then, the location (x, y) of the sensor node 120 is given by Equation 1.

$$x = \frac{x_{SL} + x_{SS}}{2},\ y = \frac{y_{SL} + y_{SS}}{2} \qquad \text{[Equation 1]}$$

Finally, the control unit 450 computes an error range of the location of the sensor node 120 (S780). The error range does not exceed the distances from the location (x, y) of the sensor node 120 to points with the minimum and maximum x-coordinates and minimum and maximum y-coordinates belonging to the shared region 810.

Figure 11:
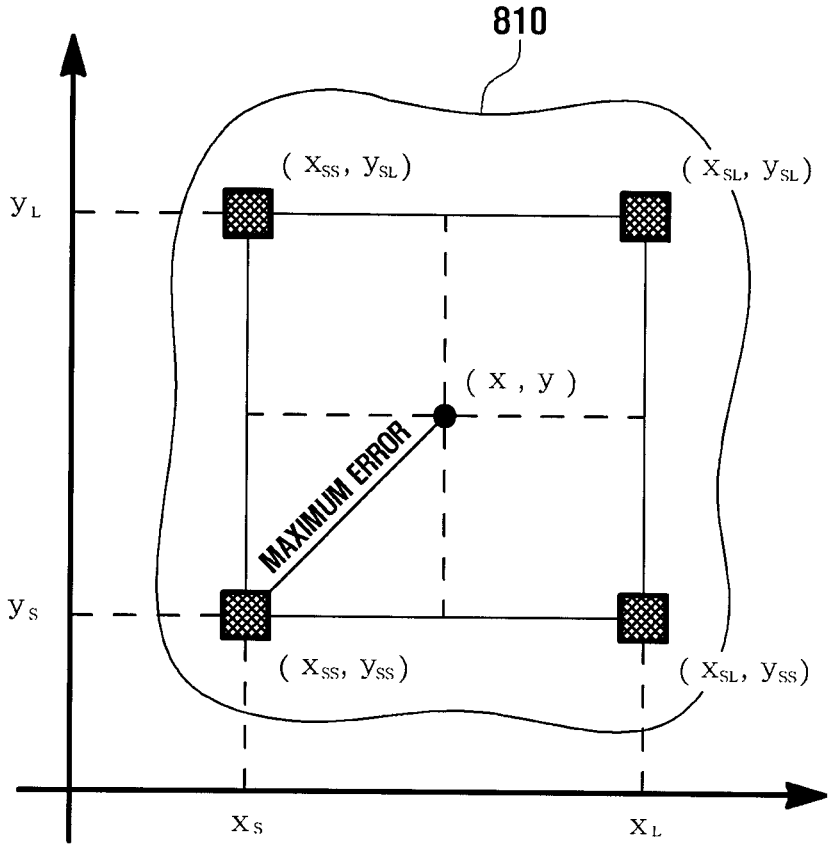
FIG. 11 illustrates calculation of an error range of a sensor node position (x, y) by a control unit of a sensor node.

FIG. 11 illustrates calculation of an error range of a sensor node position (x, y) by the control unit of a sensor node. The position (x, y) of the sensor node 120 is given by middle points of the maximum and minimum x and y values belonging to the shared region 810 as shown by Equation 1. The error range for the computed location is given by the farthest one of distances from the point (x, y) to points with the minimum and maximum x-coordinates and minimum and maximum y-coordinates belonging to the shared region 810 (points ($x_{SS}$, $y_{SS}$), ($x_{SL}$, $y_{SS}$), ($x_{SS}$, $y_{SL}$) and ($x_{SL}$, $y_{SL}$) in FIG. 11), and can be expressed in Equation 2.

$$\text{error}=\sqrt{(x-x_{SS})^2+(y-y_{SS})^2},\ \sqrt{(x-x_{SS})^2+(y-y_{SL})^2},$$

$$\sqrt{(x-x_{SL})^2+(y-y_{SS})^2} \text{ or } \sqrt{(x-x_{SL})^2+(y-y_{SL})^2} \qquad \text{[Equation 2]}$$

Although exemplary embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined in the appended claims.

What is claimed is:

1. A position locating system for a sensor network, comprising:

a plurality of reference nodes, each reference node including location information of its own location; and a sensor node for computing a location thereof on a basis of respective location information of each reference node of said plurality of reference nodes, wherein each reference node of said plurality of reference nodes comprises:

a control section for generating a location information signal including a transmit power level and said location information of its own location upon reception of a location information request signal; and a radio frequency (RF) section for forwarding the received location information request signal to the control section, and for controlling transmission power according to the transmit power level of the control section to send the generated location information signal, wherein said sensor node comprises:

a control unit for computing a location of the sensor node and an associated error of the computed location on the basis of one or more location information signals received from neighbor reference nodes;

an RF unit for sending said location information request signal to one or more of said plurality of reference nodes, and for receiving location information signals and forwarding the same to the control unit; and a storage unit storing the location information signals received from multiple neighbor reference nodes;

wherein each reference node transmits location signals at a plurality of power levels, with each power level corresponding to a known transmission range; and the control unit of the sensor node computes a position and associated error range using only a location information signal from each reference node having a lowest transmit power level among the plurality of power levels that permits position and error range computation for that reference node.

2. The position locating system of claim 1, wherein said control unit of the sensor node obtains a shared region between areas covered by said one or more location information signals of various transmit power levels from said neighbor reference nodes.

3. The position locating system of claim 2, wherein said control unit of the sensor node forms a grid of vertical and horizontal lines corresponding to a square area defined by said neighbor reference nodes, extracts coordinates of those intersections in the grid belonging to said shared region, and sets a position of the sensor node to mid-points of the extracted coordinates.

4. The position locating system of claim 1, wherein said control section of the reference node controlling the RF section for transmitting a location information signal when a random backoff time expires after reception of a location information request signal.

5. The position locating system of claim 1, wherein the reference nodes are fixed at their absolute locations.

6. The position locating system of claim 5, wherein said absolute locations of the respective reference nodes comprise geographic codes.

7. The position locating system of claim 1, wherein the reference nodes are arranged to form a square.

8. The position locating system of claim 1, wherein the reference nodes are arranged to form one of a triangle and a hexagon.

9. The position locating system of claim 7, wherein the reference nodes are arranged at corners of the square.

10. The position locating system of claim 3, wherein an error is given by a maximum distance between a computed location and points in the shared region.

11. The position locating system of claim 1, wherein the location information signal comprises a message type, a reference node identifier, absolute coordinates, a transmit power level, a maximum distance and their minimum distance.

12. The position locating system of claim 11, wherein the absolute coordinates are provided by a geographic code system including latitude and longitude.

13. A position locating method for a sensor network having a plurality of reference nodes and a sensor node, comprising:

transmitting, by the sensor node, a location information request signal;

transmitting, by neighbor reference nodes in response to reception of the location information request signal from the sensor node, location information signals to the sensor node while varying transmission power such that the location information signals are transmitted by each of the neighbor reference nodes at a plurality of power levels, with each power level corresponding to a known transmission range; and computing, by the sensor node, a location of the sensor node and associated error range of the computed location after reception and analysis of the location information signals, the location and associated error range being computed using only a location information signal from each neighbor reference node having a lowest transmit power level among the plurality of power levels for that reference node that permits position and error range computation.

14. The position locating method of claim 13, wherein the reference nodes are arranged to form a square.

15. The position locating method of claim 13, wherein the reference nodes are arranged to form one of a triangle or hexagon.

16. The position locating method of claim 13, wherein the reference nodes are arranged at corners of the square.

17. The position locating method of claim 14, wherein computing a location of the sensor node and associated error comprises:

obtaining a shared region between areas covered by location information signals of various transmit power levels from the neighbor reference nodes;

forming a grid of vertical and horizontal lines corresponding to a square area defined by the neighbor reference nodes;

extracting coordinates of those intersections in the grid belonging to the shared region; and setting the location of the sensor node to the middle points of the extracted coordinates.

18. The position locating method of claim 17, wherein in transmitting location information signals, each neighbor reference node sends a location information signal when a random backoff time expires after reception of the location information request signal.

19. The position locating method of claim 13, wherein the reference nodes are fixed at absolute locations comprising geographic codes.

20. The position locating method of claim 17, wherein computing a location of the sensor node and associated error comprises setting the error to the maximum distance between the computed location and points in the shared region.

21. The position locating method of claim 13, wherein the location information signal comprises a message type, a reference node identifier, absolute coordinates, a transmit power level, a maximum distance and a minimum distance.

22. The position locating method of claim 21, wherein the absolute coordinates are given by a geographic code system including latitude and longitude.

* * * * *

UNITED STATES PATENT AND TRADEMARK OFFICE

CERTIFICATE OF CORRECTION

PATENT NO. : 8,421,615 B2
APPLICATION NO. : 12/270898
DATED : April 16, 2013
INVENTOR(S) : Jehyok Ryu et al.

It is certified that error appears in the above-identified patent and that said Letters Patent is hereby corrected as shown below:

In the Claims:

Column 10, Claim 1, Lines 18-20 should read as follows:
--...plurality of power levels for that reference node that permits position and error range computation...--

Signed and Sealed this
Second Day of July, 2013

Teresa Stanek Rea
*Acting Director of the United States Patent and Trademark Office*